US009945203B2

(12) United States Patent
Patel

(10) Patent No.: US 9,945,203 B2
(45) Date of Patent: Apr. 17, 2018

(54) SINGLE TRIP COMPLETION SYSTEM AND METHOD

(71) Applicant: SCHLUMBERGER TECHNOLOGY CORPORATION, Sugar Land, TX (US)

(72) Inventor: Dinesh R. Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 378 days.

(21) Appl. No.: 14/166,019

(22) Filed: Jan. 28, 2014

(65) Prior Publication Data

US 2014/0209327 A1 Jul. 31, 2014

Related U.S. Application Data

(60) Provisional application No. 61/757,298, filed on Jan. 28, 2013.

(51) Int. Cl.

| | |
|---|---|
| ***E21B 33/124*** | (2006.01) |
| ***E21B 23/06*** | (2006.01) |
| ***E21B 34/06*** | (2006.01) |
| ***E21B 43/10*** | (2006.01) |
| ***E21B 33/12*** | (2006.01) |
| ***E21B 43/12*** | (2006.01) |

(52) U.S. Cl.

CPC ..... *E21B 33/12* (2013.01); *E21B 43/12* (2013.01)

(58) Field of Classification Search

CPC ..... E21B 33/122; E21B 23/03; E21B 23/00; E21B 34/06; E21B 43/08; E21B 43/10; E21B 43/20; E21B 37/00; E21B 33/124; E21B 23/06

USPC .... 166/242.6, 242.7, 227, 51, 278, 66, 54.1, 166/250.17, 250.14, 311, 312

See application file for complete search history.

(56) References Cited

U.S. PATENT DOCUMENTS

| | | | | |
|---|---|---|---|---|
| 6,513,599 | B1 * | 2/2003 | Bixenman | E21B 43/08 166/250.01 |
| 7,735,555 | B2 * | 6/2010 | Patel | E21B 17/028 166/227 |
| 7,757,773 | B2 * | 7/2010 | Rytlewski | E21B 17/06 166/376 |
| 7,896,079 | B2 * | 3/2011 | Dyer | E21B 43/14 166/105 |
| 7,980,306 | B2 * | 7/2011 | Lovell | E21B 17/206 166/250.01 |
| 8,893,794 | B2 * | 11/2014 | Patel | E21B 34/14 166/177.5 |
| 8,991,492 | B2 * | 3/2015 | Lovell | E21B 17/206 166/250.17 |
| 9,062,530 | B2 * | 6/2015 | Patel | E21B 43/04 |
| 9,194,217 | B2 * | 11/2015 | Watson | E21B 34/06 |

(Continued)

*Primary Examiner* — Kenneth L Thompson

(57) ABSTRACT

A method includes in a single trip running a completion system having an internal bore into a wellbore that penetrates a formation zone, the completion system having an upper completion connected to a lower completion, setting an isolation packer forming a barrier above the formation zone, displacing the annulus fluid above the set isolation packer and then setting an upper packer thereby providing a completion barrier above the set isolation packer. The annulus fluid may be displaced prior to setting an upper completion packer.

21 Claims, 7 Drawing Sheets

(56) References Cited

U.S. PATENT DOCUMENTS

2008/0302529 A1* 12/2008 Fowler, Jr. ..... E21B 33/124
166/250.01
2009/0288824 A1* 11/2009 Fowler, Jr. ..... E21B 33/124
166/250.17

* cited by examiner

SINGLE TRIP COMPLETION SYSTEM AND METHOD

BACKGROUND

This section provides background information to facilitate a better understanding of the various aspects of the disclosure. It should be understood that the statements in this section of this document are to be read in this light, and not as admissions of prior art.

Hydrocarbon fluids such as oil and natural gas are obtained from a subterranean geologic formation, referred to as reservoir, by drilling a well that penetrates the hydrocarbon-bearing formation. Completion equipment, which may include a complex system of equipment to regulate flow of the fluid, is then installed in the wellbore. In some applications, a lower completion and an upper completion are both deployed downhole into a wellbore. At least two runs, or trips, into the wellbore are often required for purposes of installing the completion equipment. A lower completion is commonly run first to the heel of the wellbore, which may be located furthest from the surface. Subsequent to this run, an upper completion is commonly run into the well to provide the tubing and mechanisms required to connect the lower completion to a hydrocarbon removal point or wellhead location, for example. When the upper completion is in need of service or updating, a workover is sometimes performed by pulling the entire completion. In many of these applications, the well is killed to enable safe retrieval of the completion system.

SUMMARY

In accordance to an embodiment, a single trip completion system includes an upper completion and a lower completion connected at a coupler to be run into a wellbore as a unit in a single trip. The lower completion includes an isolation packer, a fluid communication valve located above the isolation packer to control communication between a bore of the completion and an annulus of the wellbore, and an upper packer located above the fluid communication valve. In accordance to an embodiment a method includes in a single trip running a completion system having an internal bore into a wellbore that penetrates a formation zone, the completion system having an upper completion connected to a lower completion, setting an isolation packer forming a barrier above the formation zone, displacing the annulus fluid above the set isolation packer and then setting an upper packer thereby providing a completion barrier above the set isolation packer. In accordance to embodiments, the annulus fluid is displaced prior to setting an upper completion packer.

The foregoing has outlined some of the features and technical advantages in order that the detailed description of the single trip completion system and method that follows may be better understood. Additional features and advantages of the single trip completion system and method will be described hereinafter which form the subject of the claims of the invention. This summary is not intended to identify key or essential features of the claimed subject matter, nor is it intended to be used as an aid in limiting the scope of claimed subject matter.

BRIEF DESCRIPTION OF THE DRAWINGS

Embodiments of single trip completion systems and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
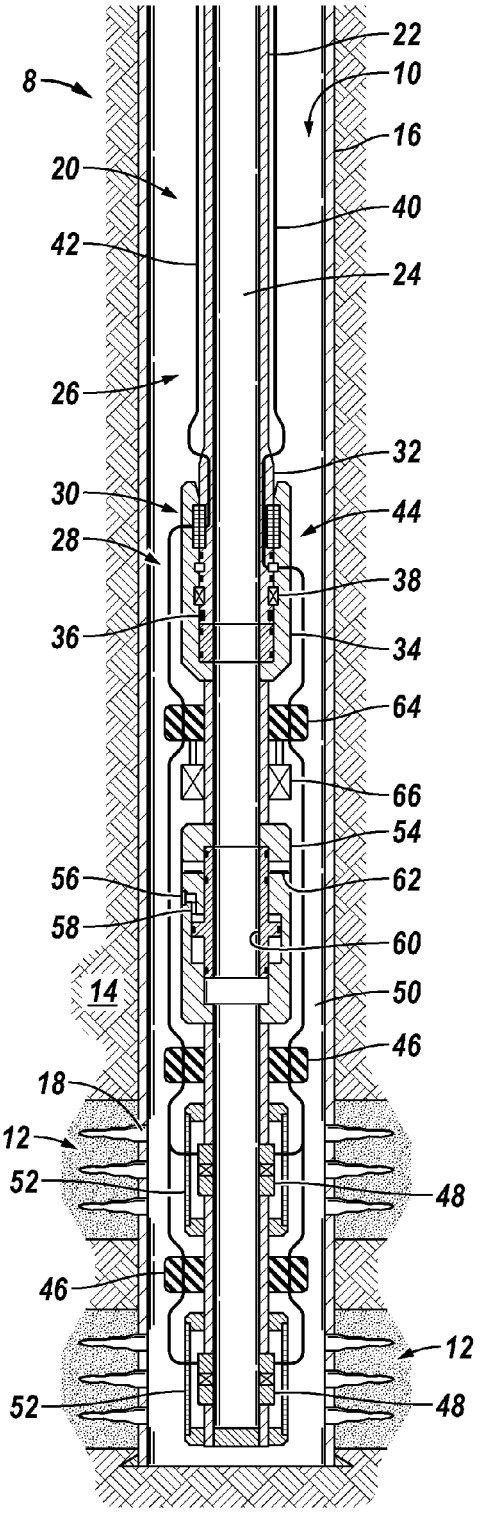
FIGS. 1-4 and 7-10 are schematic illustrations of a single trip completion system being installed in a wellbore in accordance with one or more embodiments.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect," "connection," "connected," "in connection with," and "connecting" are used to mean "in direct connection with" or "in connection with via one or more elements"; and the term "set" is used to mean "one element" or "more than one element". Further, the terms "couple," "coupling," "coupled," "coupled together," and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

With reference generally to FIGS. 1-12, and in particular to FIG. 1, a well 8 is illustrated having a wellbore 10 extending through one or more zones 12 of the surrounding earthen formation/reservoir 14. In the illustrated examples the wellbore includes casing 16 extending from the surface, e.g. wellhead, to the penetrated zones 12. Fluid communication between zones 12 and the wellbore is provided through openings 18 formed in casing 16 adjacent to the zones 12. Wellbore 10 may be a bare foot completion, having an open hole section. For example casing 16 may not extend the total depth of the wellbore leaving the lower section of wellbore 10 adjacent to zones 12 uncased, i.e. open.

A single trip completion system 20 in accordance to embodiment is illustrated deployed in wellbore 10. The illustrated completion system 20 is part of a tubular string 22 having an internal bore 24. Single trip completion system 20 requires only a single trip into the wellbore for the purpose of installing what is considered the upper and lower completion, which are referred to herein as the upper section or upper completion 26 and the lower section or lower completion 28. In FIGS. 1-4, upper completion 26 does not include a completion packer. In FIGS. 7-10, upper completion 26 includes a completion packer 68.

Upper completion 26 is connected to and sealed with lower completion 28 by a coupling system or coupler 30. In the illustrated example, a mandrel or extension 32 of upper completion 26 is stabbed into a polished bore receptacle (PBR) 34 of lower completion 28. Sealing elements 36 provide a seal between the upper and the lower completion. A latch 38 releasably connects the upper and lower completions. Latch 38 may be actuated in various manners, for example and without limitation, by straight pull, via hydraulic signals conveyed through a control line, the tubing bore, or the annulus, via an electrical signal, and via mechanical manipulation for example of a threaded or collet type latch. Various latch configurations and various manners of actuation are contemplated and are within the scope of this disclosure.

Figure 6:
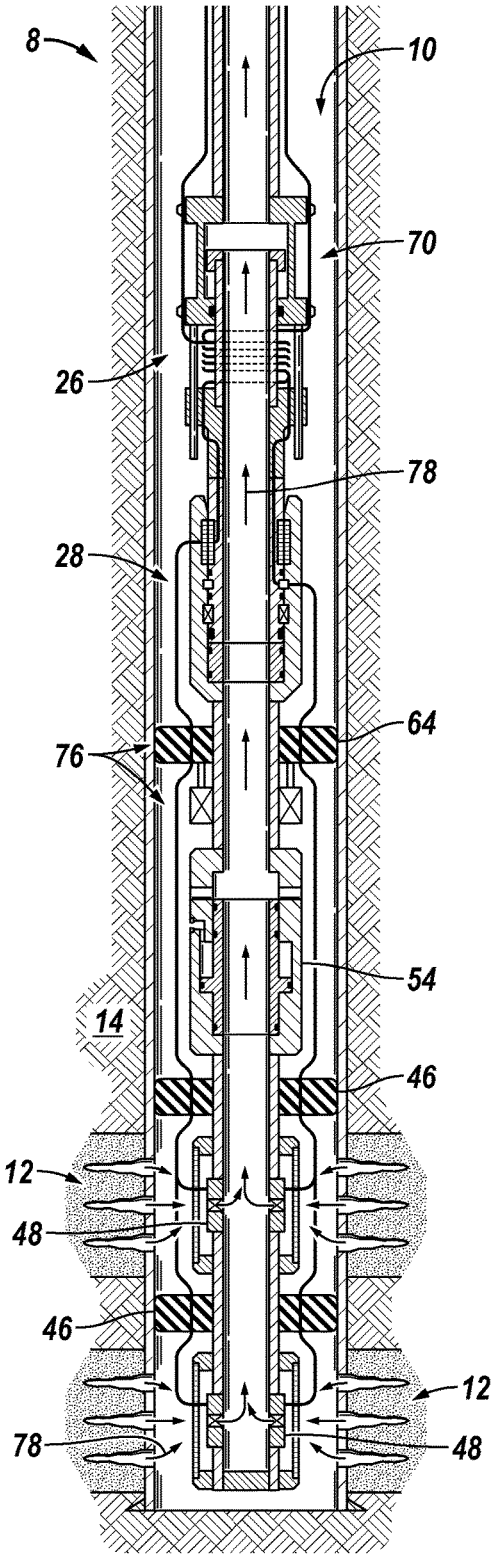
FIGS. 6 and 12 are schematic illustrations of subsequent upper completion deployed in the wellbore and connected to the lower completion in accordance with one or more embodiments.
Figure 12:
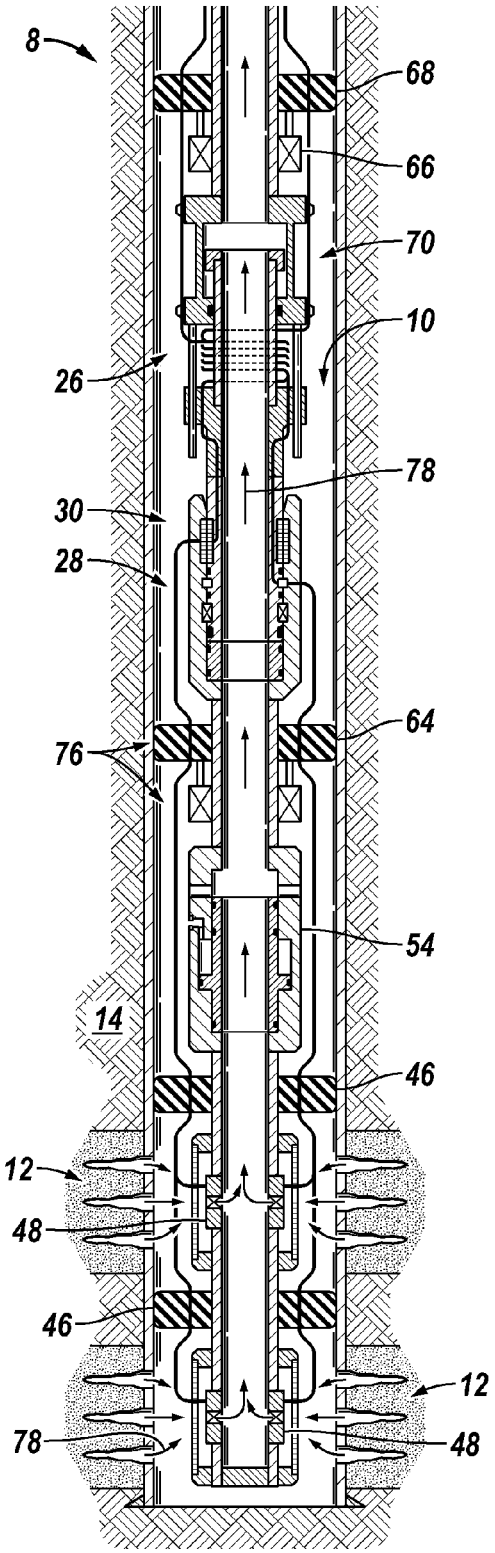

Completion system 20 may include a variety of components designed to facilitate different types of well operation, including well production operations, well treatment operations, and other well related operations. Various components are illustrated although the type, number and arrangement of components may vary substantially from one application to another. By way of example, completion 20 includes a plurality of communication lines, e.g. control lines, such as at least one hydraulic communication line 40 and at least one electric communication line 42. Communication lines 40, 42 may be selectively connected and disconnected by a hydroelectric wet mate (HEWM) 44 for example including extension 32 and PBR 34. For example, the HEWM may have hydraulic wet connections for the one or more hydraulic communication lines. The HEWM may include without limitation inductive couplers and or direct electrical contact type connectors for the electric communication line for transmitting electric power and for communication. HEWM 44 may be a PBR and stinger seal assembly type seal assembly, pine and bore type, or other type of connection. A tubing movement compensation joint may be employed in completion system 20. FIGS. 6 and 12 illustrate an example of a tubing movement compensation joint (TMCJ) 70 employed in upper completion 26.

Completion system 20 may include various upper completion components such as and without limitation a surface controlled subsurface safety valve and gas lift mandrels. Additionally, lower completion 28 may include various components such as a plurality of isolation packers 46 to isolate zones 12 along wellbore 10. Packer 46 is referred to herein as an isolation packer for the purpose of clarity the term is not intended to be limiting. For example, in the illustrated example packer 46 is isolating the formation zones in a cased wellbore section. In some wellbores, packer 46 may be isolating the formation zones located in an open hole section, i.e. uncased portion, of the wellbore. In the illustrated examples, lower completion 28 includes at least one flow control valve (FCV) 48 for controlling the flow of fluid between completion bore 24 and the annular region 50, i.e. annulus, surrounding completion 20. The flow control valves are positioned below the upper most isolation packer 46. FCV 48 may be actuated, for example, in response to a hydraulic signal transmitted for example via hydraulic communication line 40. Flow control valve 48 is illustrated incorporated in a screen 52. In accordance to some embodiments, screen 52 may be a stand-alone screen and lower completion 28 may not include a flow control valve. Lower completion 28 may include other components, such as and without limitation, sensors, stimulation valves, chemical injection mandrels and gas lift mandrels.

When the isolation packers 46 are set, previous single trip completion systems preclude circulating or displacing the annulus fluid above the set isolation packers. Single trip completion system 20 incorporates a fluid communication valve 54 located in lower completion 28 above the upper most isolation packer 46. As further described below, fluid communication valve 54 allows for fluid in annulus 50 to be displaced and replaced with a second annulus fluid, in particular a packer or completion fluid, after the upper isolation packer 46 has been set and prior to setting a completion packer for example in the upper completion. A packer or completion fluid is a fluid that is left in the annulus between the tubing and the outer casing for example above upper most isolation packer 46. The packer or completion fluid is utilized to provide hydrostatic pressure to lower the differential pressure across the packer sealing element, to lower the pressure differential pressure on the wellbore and casing to prevent collapse, and it may be chemically determined to protect metals and elastomers from corrosion.

Fluid communication valve 54 is illustrated as an annulus pressure actuated fluid communication valve. For example, annulus 50 pressure is increased to rupture an element 56 communicating annulus pressure through a port 58 to move an element 60, for example a sleeve, thereby opening a flow passage 62 between annulus 50 and completion bore 24. It will be understood by those skilled in the art with benefit of this disclosure that the illustrated communication valve is a non-limiting example of the types of communication valves that facilitate circulation of fluids between the internal bore 24 and the annulus 50 that may be utilized. For example, and without limitation, communication valve 54 may be actuated via tubing or control line conveyed hydraulic pressure or electrically actuated. Depending on the particular implementation, the valve may be operated by a control line or dual control lines. The valve may use wireless communication systems to open and close the valve. Thus, many variations for controlling and operating communication valve 54 are contemplated and are within the scope of this disclosure.

In accordance to one or more embodiments, single trip completion system 20 includes an upper packer 64, i.e. annular barrier, incorporated in lower completion 28 between upper completion 26 and fluid communication valve 54. As further described blow, when the annulus fluid 72 is displaced (FIGS. 3, 9) and upper packer 64 is set (FIGS. 4, 10) a completion barrier is provided for example for the life of the well. This completion barrier facilitates disconnecting and pulling upper completion 26 out of the well without creating well control issues.

A non-limiting example of upper packer 64 is illustrated being hydrostatic pressure actuated packer and including a hydrostatic set module (HSM) 66. Packer 64 is not limited to hydrostatic pressure actuated valves and other types of packers are contemplated and are within the scope of this disclosure. Upper packer 64 may be a multiple port packer having feedthroughs for control lines, such as communication lines 40, 42.

Figure 4:
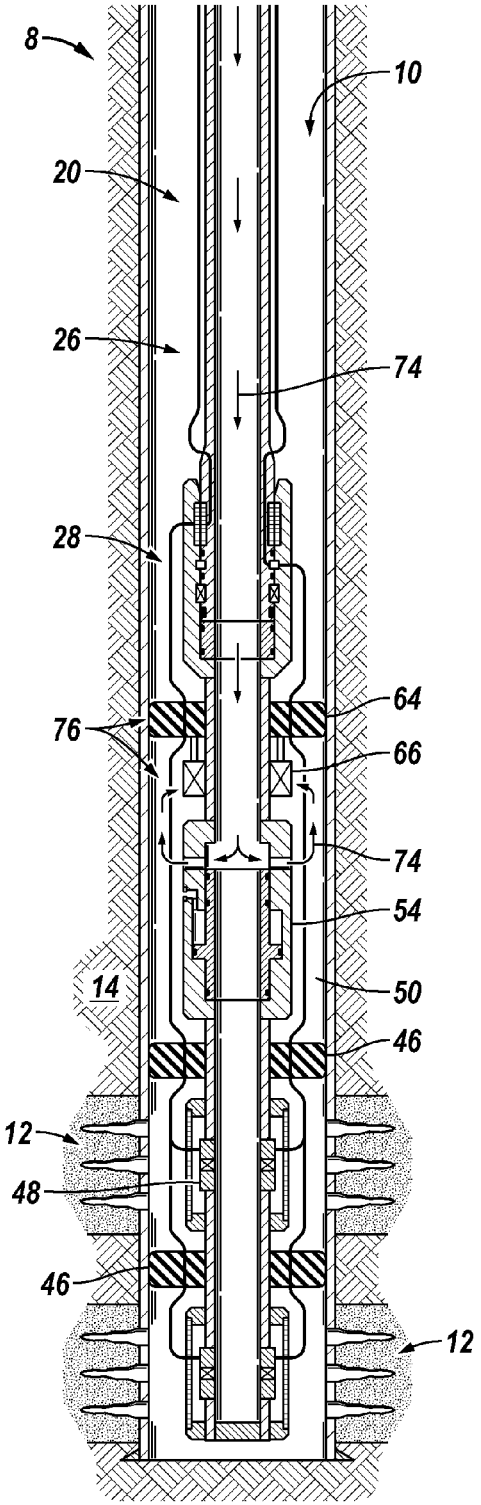
Figure 5:
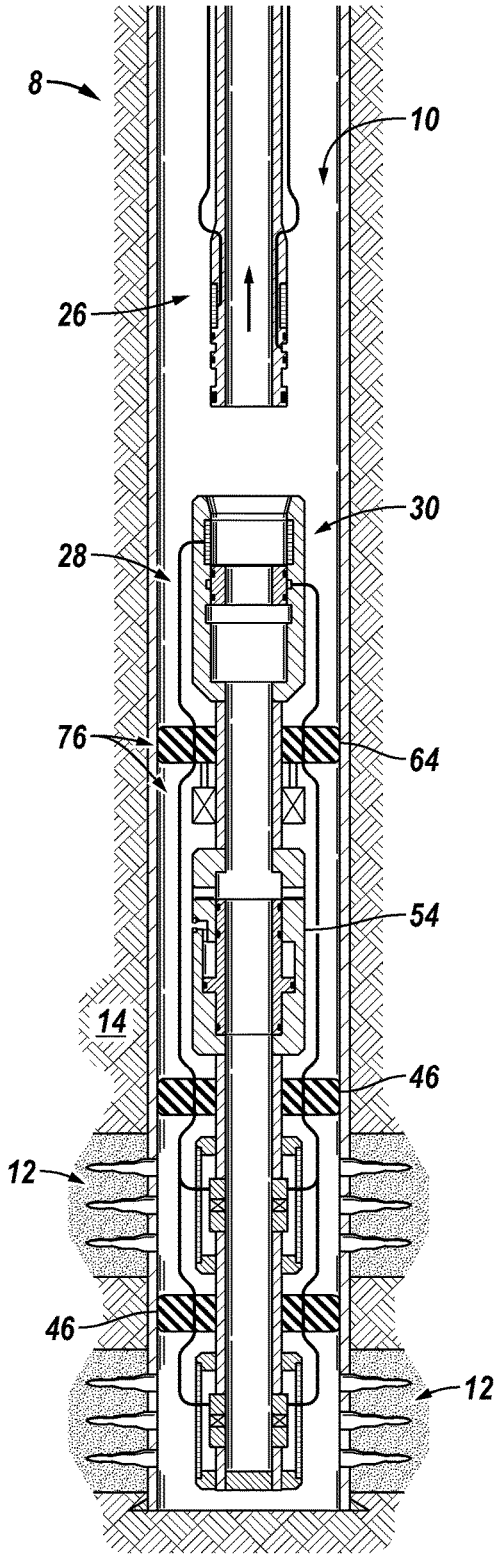
FIGS. 5 and 11 are schematic illustrations of an upper completion of a single trip completion system being pulled out of wellbore in accordance with one or more embodiments.
Figure 10:
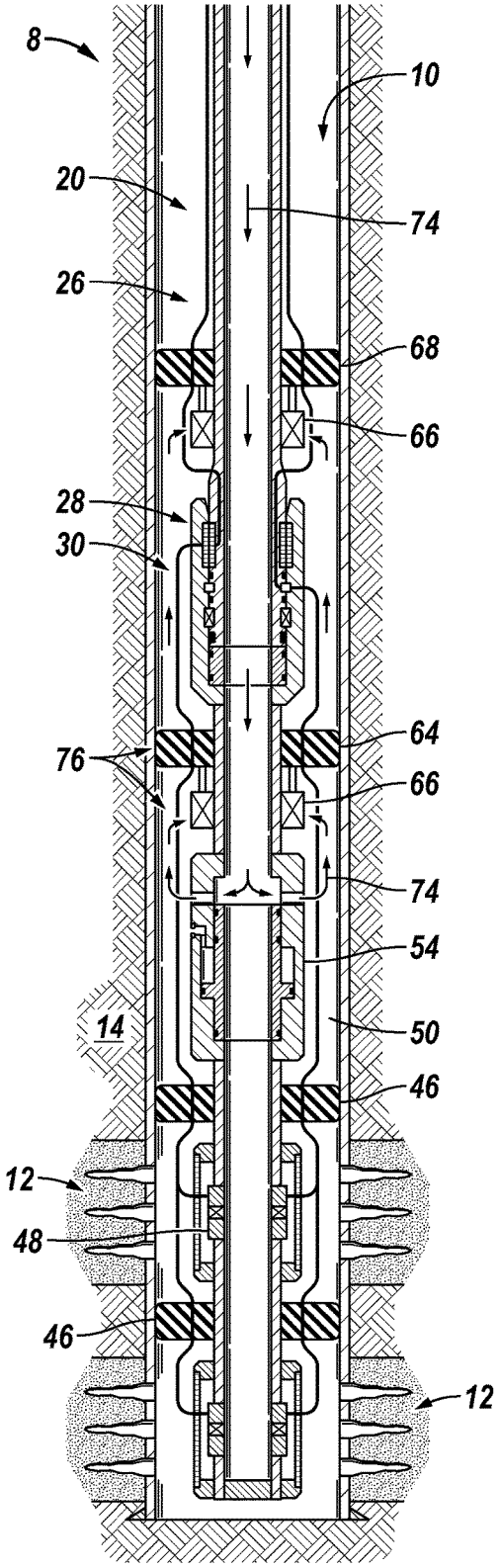
Figure 11:
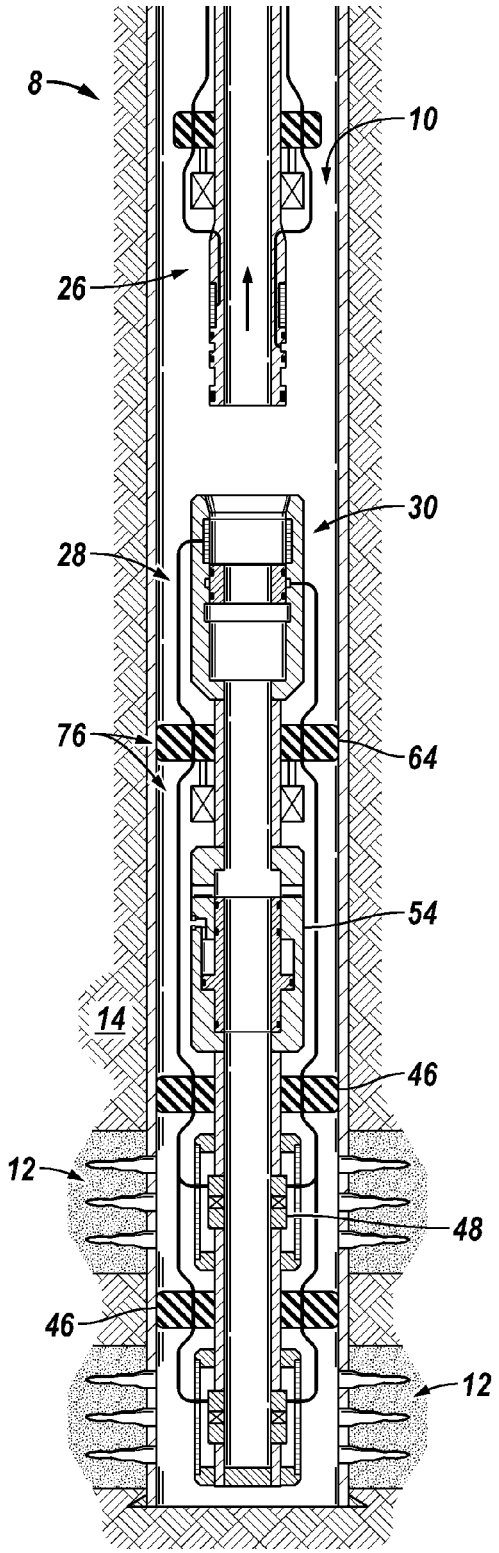
Figure 13:
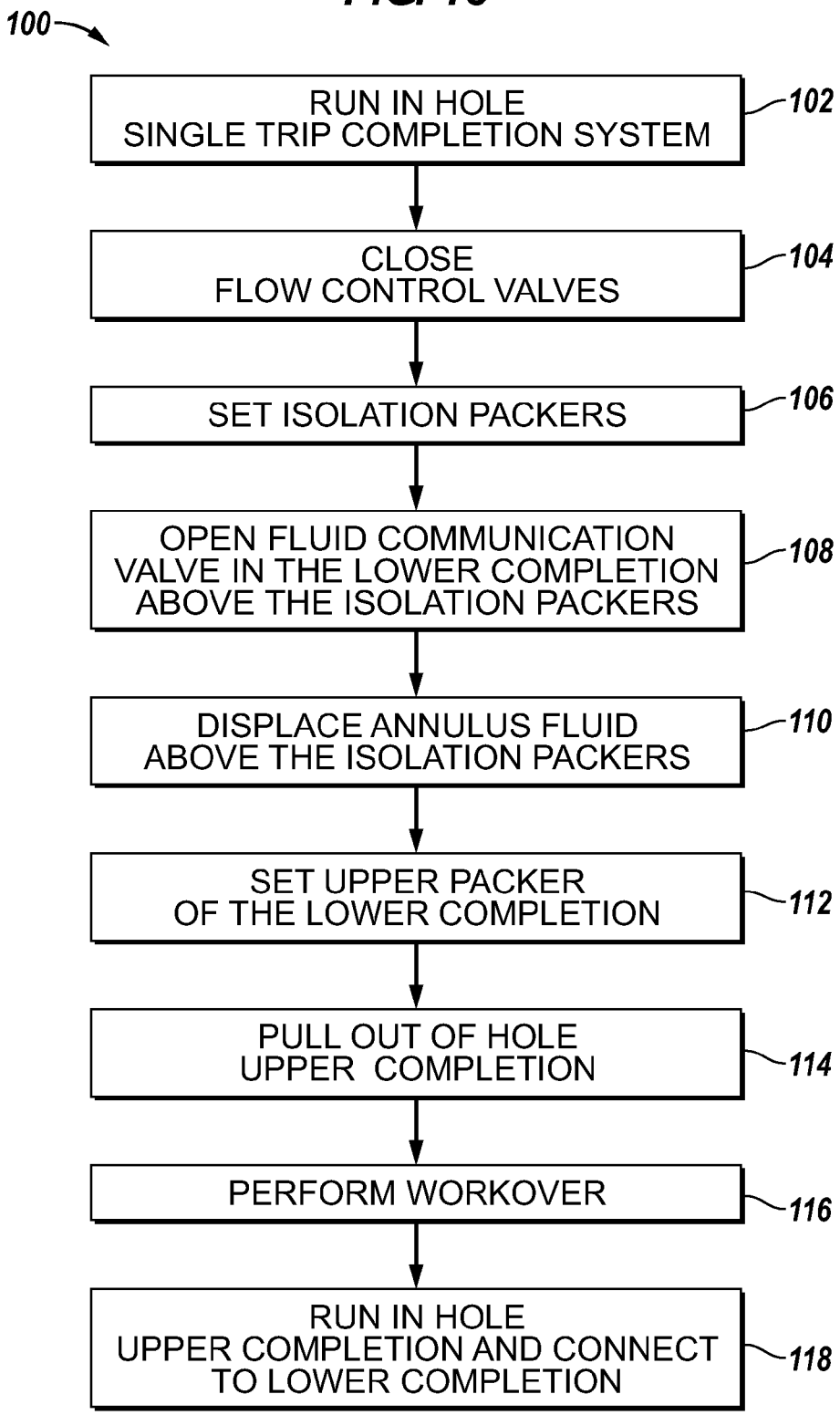
FIG. 13 is a flow diagram depicting a method for running a single trip completion system in accordance with one or more embodiments.

Referring now to FIG. 13, a flow diagram of a method 100 for running a single trip completion in accordance to an example is depicted. FIG. 13 is described with additional reference to FIGS. 1-12. FIGS. 1-4 and 7-10 illustrate running a single trip completion system 20 into the wellbore, setting the isolation packers 46, and displacing the annulus fluid 72 prior to setting a completion packer for example in the upper completion. FIGS. 5 and 11 illustrate pulling upper completion 26 out of the hole, i.e., wellbore, for example to perform a workover. In FIGS. 1-6, upper completion 26 is illustrated without a completion packer. In FIGS. 7-12, upper completion 26 includes a completion packer 68. FIGS. 6 and 12 illustrate running in hole with an upper completion 26 and placing well 8 on production. In the examples of FIGS. 6 and 12, upper completion 26 includes a tubing movement compensation joint 70.

Figure 2:
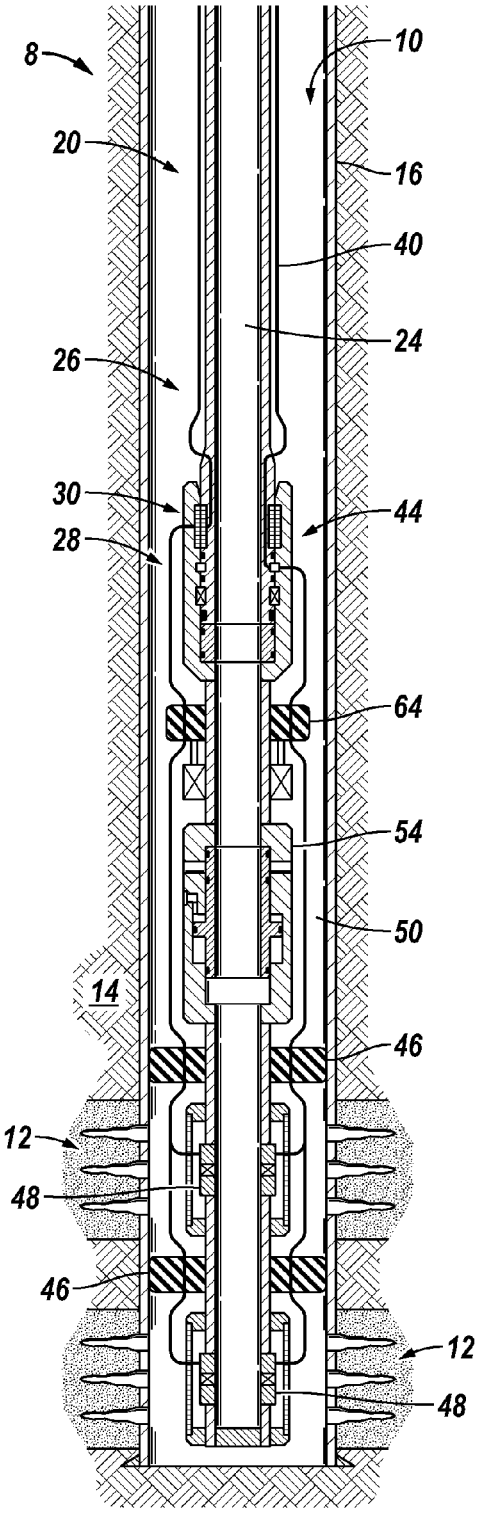
Figure 7:
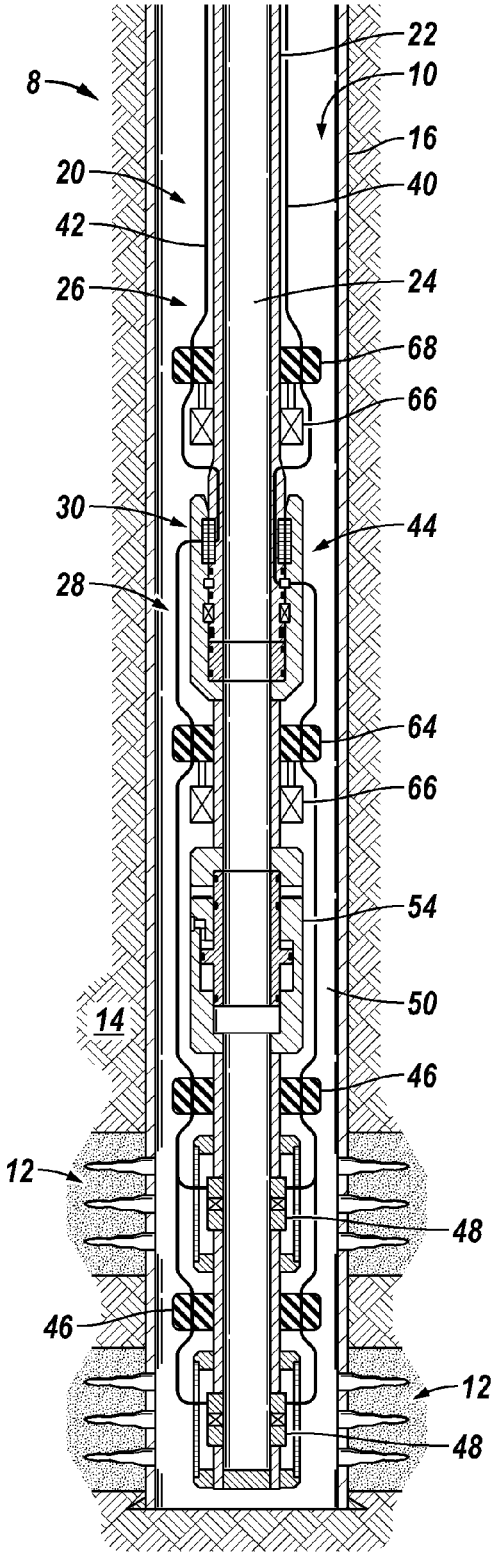
Figure 8:
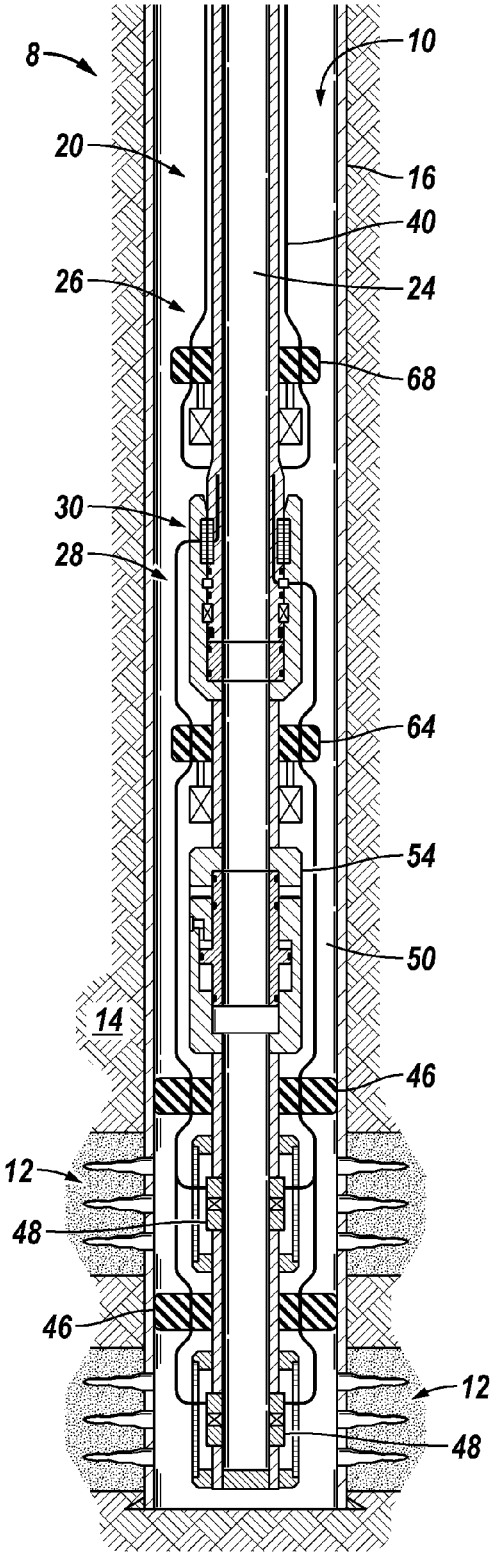

At block 102, single trip completion system 20 is run-in-hole (RIH) and positioned in wellbore 10 for example as illustrated in FIGS. 1 and 7. At block 104 the fluid control valves 48 are closed as illustrated in FIGS. 2 and 8, for example via a hydraulic signal conveyed through hydraulic communication line 40. At block 106, isolation packers 46 are set providing an annular barrier above zones 12 as shown in FIGS. 2 and 8. For example, isolation packers may be set by applying hydraulic pressure in the tubing bore to expand packers 46 to seal against the wellbore wall. As discussed above, lower completion 28 may not include flow control valves 48. The lower completion below the isolation packers 46 may be sealed if needed for example, and without limitation, with a plug or formation isolation valve.

Figure 3:
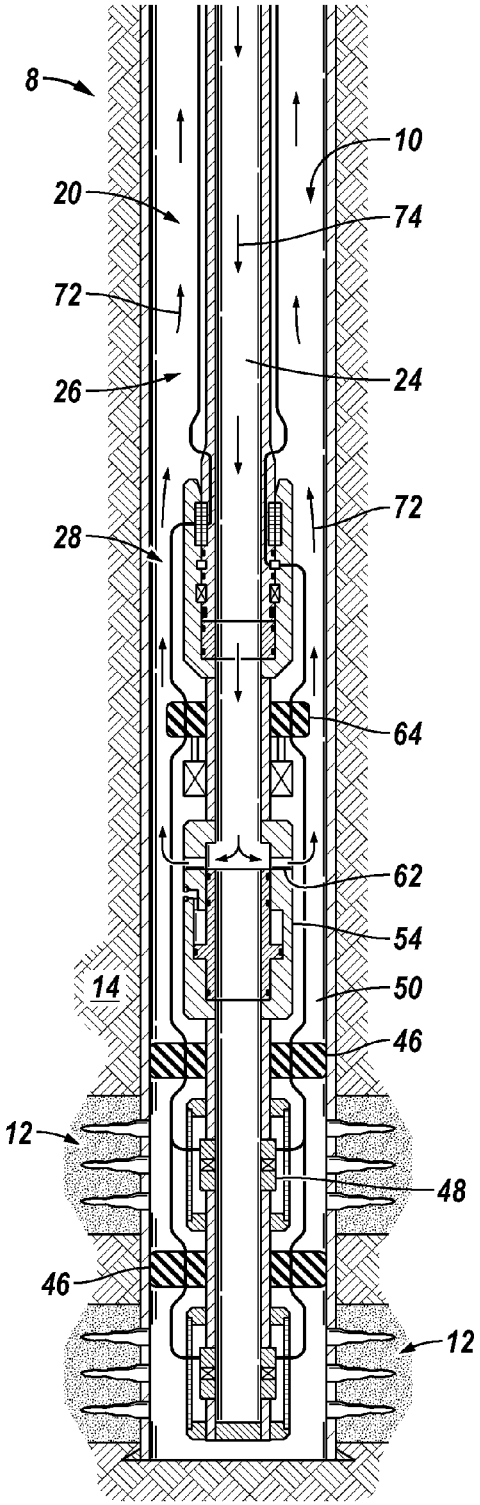
Figure 9:
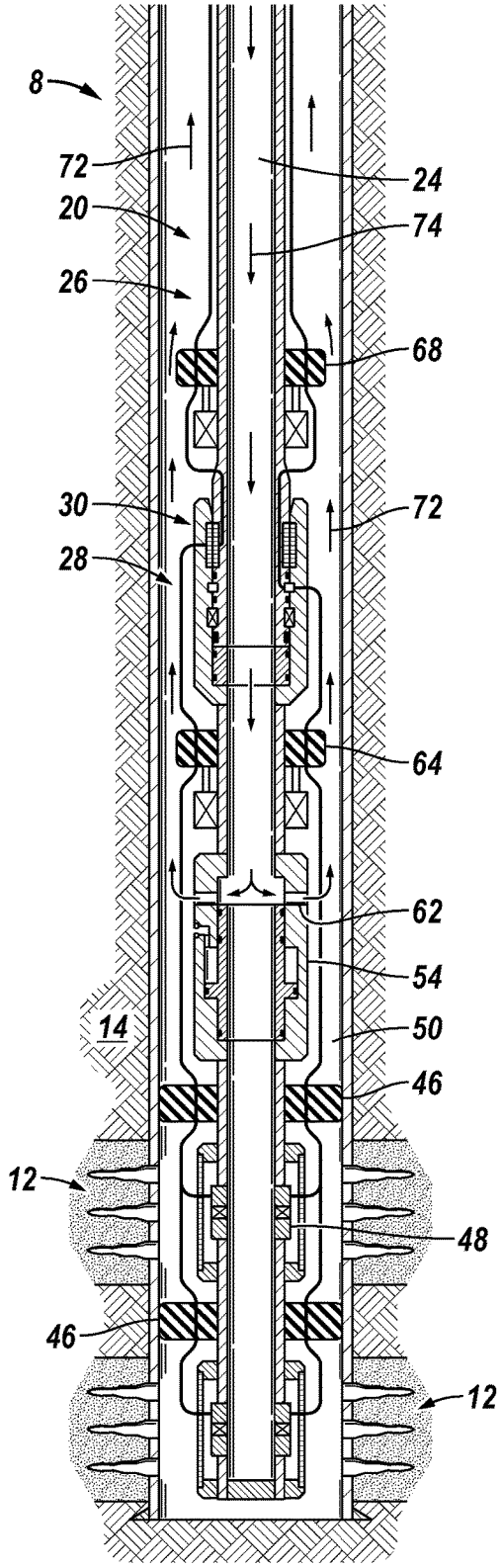

With reference to FIGS. 3 and 9, fluid communication valve 54 is opened (block 108) establishing fluid communication between annulus 50 and bore 24. The initial annulus fluid 72 is displaced (block 110) with a second fluid 74, for example completion or packer fluid. In FIGS. 3 and 9, completion fluid 74 is circulated from the surface down bore 24 and through passage 62 of fluid communication valve 54 into annulus 50 thereby displacing annulus fluid 72 to the surface. With reference to FIGS. 4 and 10, upper packer 64 is set (block 112) creating a completion barrier 76 (annular barrier) above the upper most isolation packer 46. Completion barrier 76 may stay in place for the life of the well. In the illustrated example, upper packer 64 in the lower completion and in FIG. 10 the completion packer 68 in upper completion 26 are both set by activating hydrostatic setting module 66 in response to increasing the pressure in the annulus 50, for example via completion fluid 74. It will be understood by those skilled in the art with benefit of this disclosure that upper packer 64 and or completion packer 68 may be actuated and set in various ways. Fluid communication valve 54 may then be closed in preparation for additional operations such as without limitation, stimulating the zones, performing a workover, and placing the well on production. As will be understood by those skilled in the art with benefit of this disclosure, various manners of closing fluid communication valve 54 may be utilized.

With upper packer 64 set, a completion barrier 76 is in place and upper completion 26 may be disconnected and pulled out of the hole (POOH) without creating a well control issue. Latch 38, see FIG. 1, is actuated to release the connection of upper completion 26 from lower completion 28. In FIGS. 5 and 11, upper completion 26 is illustrated being pulled (block 114) out of wellbore 10. With upper completion 26 removed from the wellbore, workover operations can be performed (block 116). At block 118, an upper completion 26 is run-in-hole (RIH) and connected to lower completion as illustrated in FIGS. 6 and 12. In the examples of FIGS. 6 and 12, the upper completions include a tubing movement compensation joint (TMCJ) 70. In FIG. 6, TMCJ 70 is a sealing compensation joint. With reference to FIG. 12, upper completion 26 includes an upper completion packer 68 which may be set in various ways, including via a hydrostatic setting module 66. With reference to FIG. 12, TMCJ 70 is located below completion packer 68 and may be a non-sealing compensation joint. With the upper completion connected to lower completion 28 the well can be placed on production, FIGS. 6 and 12, by opening flow control valves 48 allowing reservoir fluid 78 to be produced to the surface.

The foregoing outlines features of several embodiments of single trip completion systems and methods so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method, comprising:

in a single trip running a completion system having an internal bore into a wellbore that penetrates a plurality of formation zones, the completion system comprising an upper completion connected to a lower completion;

setting a plurality of isolation packers to form barriers above corresponding formation zones in an annulus between the lower completion and the wellbore, wherein the lower completion comprises a stand-alone screen located below each isolation packer;

displacing an annulus fluid above the set plurality of isolation packers by routing a fluid down through the internal bore, out into a surrounding annulus, and up to a surface through the annulus until the annulus fluid is displaced; and after the displacing, setting an upper packer thereby providing a completion barrier above the plurality of isolation packers.

2. The method of claim 1, comprising after the setting the upper packer disconnecting the upper completion from the lower completion, and pulling the disconnected upper completion from the wellbore.

3. The method of claim 1, wherein the lower completion comprises a flow control valve located below each isolation packer.

4. The method of claim 1, wherein the displacing the annulus fluid comprises communicating the fluid from the internal bore through a fluid communication valve into the annulus.

5. The method of claim 1, wherein the upper packer is located in the lower completion and a fluid communication valve is located between the upper packer and the uppermost isolation packer, wherein the displacing the annulus fluid comprises communicating the fluid from the internal bore through the fluid communication valve into the annulus.

6. The method of claim 1, wherein the upper completion comprises a completion packer, wherein the displacing the annulus fluid is performed before setting the completion packer.

7. The method of claim 6, comprising after the setting the upper packer disconnecting the upper completion from the lower completion, and pulling the disconnected upper completion from the wellbore.

8. The method of claim 6, wherein the displacing the annulus fluid comprises communicating the fluid from the internal bore through a fluid communication valve into the annulus.

9. The method of claim 6, wherein the upper packer is located in the lower completion and a fluid communication valve is located between the upper packer and the uppermost isolation packer, wherein the displacing the annulus fluid comprises communicating the fluid from the internal bore through the fluid communication valve into the annulus.

10. A method, comprising:

in a single trip running a completion system having an internal bore into a wellbore penetrating a formation zone, the completion system comprising an upper completion connected at a coupler to a lower completion, wherein the lower completion comprises an isolation packer, a fluid communication valve located above the isolation packer operable to control fluid communication between the internal bore and an annulus of the wellbore, and an upper packer located above the fluid communication valve;

setting the isolation packer above the formation zone;

displacing an annulus fluid above the set isolation packer in response to circulating a fluid from the internal bore through the fluid communication valve, into the annulus, and up to a surface until the annulus fluid is displaced;

establishing a hydrostatic pressure in the annulus via the fluid, the hydrostatic pressure being different than a previous hydrostatic pressure established via the annulus fluid prior to being displaced; and after the displacing setting the upper packer thereby providing a completion barrier above the isolation packer.

11. The method of claim 10, wherein the upper completion comprises a packer, wherein the displacing the annulus fluid is performed before the packer of the upper completion is set.

12. The method of claim 10, further comprising after the setting the upper packer of the lower completion, disconnecting the upper completion at the coupler and pulling the upper completion out of the wellbore.

13. The method of claim 12, further comprising:

after providing the completion barrier, disconnecting the upper completion at the coupler and pulling the upper completion out of the wellbore; and running the upper completion back into the wellbore and connecting to the lower completion.

14. The method of claim 10, wherein the lower completion comprises a flow control valve located below the isolation packer.

15. A method, comprising:

in a single trip running a completion system having an internal bore into a wellbore that penetrates a plurality of formation zones, the completion system comprising an upper completion connected to a lower completion;

setting a plurality of isolation packers to form barriers above corresponding formation zones in an annulus between the lower completion and the wellbore;

displacing an annulus fluid above the set plurality of isolation packers by routing a fluid down through the internal bore, out into a surrounding annulus, and up to a surface through the annulus until the annulus fluid is displaced; and after the displacing, setting an upper packer thereby providing a completion barrier above the plurality of isolation packers, wherein the upper packer is located in the lower completion and a fluid communication valve is located between the upper packer and the uppermost isolation packer, wherein the displacing the annulus fluid comprises communicating the fluid from the internal bore through the fluid communication valve into the annulus.

16. The method of claim 15, comprising after the setting the upper packer disconnecting the upper completion from the lower completion, and pulling the disconnected upper completion from the wellbore.

17. The method of claim 15, wherein the lower completion comprises a flow control valve located below each isolation packer.

18. The method of claim 15, wherein the displacing the annulus fluid comprises communicating the fluid from the internal bore through a fluid communication valve into the annulus.

19. The method of claim 15, wherein the upper completion comprises a completion packer, wherein the displacing the annulus fluid is performed before setting the completion packer.

20. The method of claim 19, comprising after the setting the upper packer disconnecting the upper completion from the lower completion, and pulling the disconnected upper completion from the wellbore.

21. The method of claim 19, wherein the displacing the annulus fluid comprises communicating the fluid from the internal bore through a fluid communication valve into the annulus.

* * * * *